United States Patent [19]

Wilmotte et al.

[11] Patent Number: 4,723,562

[45] Date of Patent: Feb. 9, 1988

[54] APPARATUS FOR COOLING A MOVING METAL PRODUCT

[75] Inventors: Stéphan Wilmotte, Chaudfontaine; Jean-Francois Noville, Liers, both of Belgium

[73] Assignee: Centre de Recherches Metallurgiques—Centrum Voor Research in de Metallurgie, Brussels, Belgium

[21] Appl. No.: 785,409

[22] Filed: Oct. 8, 1985

[30] Foreign Application Priority Data

Oct. 9, 1984 [BE] Belgium ..... 6/48016

[51] Int. Cl.[4] ..... B08B 3/02

[52] U.S. Cl. ..... 134/122 R; 134/199; 266/113; 266/133

[58] Field of Search ..... 134/64 R, 105, 122 R, 134/199; 266/112, 113, 120, 130, 133; 118/418; 239/DIG. 19

[56] References Cited

U.S. PATENT DOCUMENTS

| | | | |
|---|---|---|---|
| 3,025,865 | 3/1962 | Adcock | 134/122 R |
| 3,423,254 | 1/1969 | Safford et al. | 266/113 X |
| 3,546,911 | 12/1970 | Lenz | 266/130 X |
| 3,785,572 | 1/1974 | Arnold et al. | 239/DIG. 19 |
| 3,897,230 | 7/1975 | Taylor et al. | 134/64 R X |
| 4,076,222 | 2/1978 | Schaming | 134/122 R X |
| 4,125,225 | 11/1978 | Venghiattis | 239/DIG. 19 |
| 4,132,393 | 1/1979 | Nakamura et al. | 266/113 X |
| 4,149,703 | 4/1979 | Safford | 266/113 X |
| 4,300,376 | 11/1981 | Wilmotte | 266/113 X |
| 4,415,143 | 11/1983 | Ebata | 266/112 |
| 4,486,009 | 12/1984 | Kopf | 266/133 X |

FOREIGN PATENT DOCUMENTS

| | | | |
|---|---|---|---|
| 59-16619 | 1/1984 | Japan | 134/122 R |

*Primary Examiner*—Harvey C. Hornsby
*Assistant Examiner*—Frankie L. Stinson
*Attorney, Agent, or Firm*—Holman & Stern

[57] ABSTRACT

A metal product having at least one plane surface, e.g. steel strip, is cooled by means of an aqueous fluid as it moves along a predetermined path by apparatus comprising a wall disposed opposite the plane surface of the product and substantially parallel thereto so as to form a chamber of substantially constant thickness between the plane surface and the wall, at least one aperture in the wall communicating with the chamber for the passage of the aqueous fluid connected to the aperture through the wall. The aperture is connected to a source of the aqueous fluid. The rate of flow of the aqueous fluid and the spacing between the wall and the plane surface are both adjustable.

19 Claims, 5 Drawing Figures

APPARATUS FOR COOLING A MOVING METAL PRODUCT

BACKGROUND OF THE INVENTION

1. Field of the Invention

The present invention relates to apparatus for cooling a moving metal product. It may be applied to any metal product moving along a line and having at least one plane surface. This is the case, for example, with rolled products such as sheet, and in particular heavy and medium sheet, thin strip, and profiled sections, as well as continuous casting products such as slabs and billets.

2. Description of the Prior Art

Research has been continuing for some time now into the problem of cooling these products, as this cooling essentially influences the structural uniformity of the product as well as its uniform development over time. Various devices are currently known which provide for this cooling by spraying jets of a cooling agent such as air, water, or steam, on their own, in combination, or in an atomized form. In particular, Belgian Patent Specification No. 851 381 discloses a device designed to carry out the cooling of a product of this type by spraying water atomized in air in the form of jets directed at the surface of the product. This device has, however, certain drawbacks which become increasingly problematic, the wider the product to be cooled.

The device has a relative complex structure comprising caissons disposed within one another which are difficult to construct and maintain, particularly if the products are very wide. In addition, there is a very high consumption of compressed air for atomization. Finally, special devices, which increase the cost of the plant, have to be used to maintain uniform flow rates for the air and water.

BRIEF SUMMARY OF THE INVENTION

The present invention provides apparatus designed to cool a metal product having at least one plane surface by means of an aqueous fluid, which metal product moves along a predetermined path, comprising a wall disposed opposite the plane surface of the product to be cooled and substantially parallel thereto so as to form a chamber of substantially constant thickness between the plane surface and the wall, the wall being provided with at least one aperture communicating with the chamber for the passage of the aqueous fluid through the wall, the aperture being connected to a source of the aqueous fluid, and means for adjusting the rate of flow of the aqueous fluid and the spacing between the wall and the plane surface of the product to be cooled.

In a particular embodiment, the apertures are distributed in a zig-zag form, at least in a portion of the wall facing the plane surface of the product to be cooled.

It has proved advantageous to line the apertures with a material which is resistant to corrosion by the aqueous fluid. In this respect, the apertures are advantageously provided with rings, for example of brass or stainless steel, having an internal diameter of the required value.

In a particularly advantageous embodiment the wall provided with the apertures forms one face, called the front face, of a caisson for the distribution of the aqueous fluid onto the plane surface of the product to be cooled. The apertures provided in the front face of the caisson are advantageously provided with tubular members extending within the caisson. The length of these tubular members is preferably no less than five times their inner diameter. In addition, the tubular members are preferably made of a material which is resistant to corrosion by the aqueous fluid, preferably brass or stainless steel.

The presence of these tubular members enables the prevention of any obstruction of the apertures by matter possibly collecting in the base of the caisson, when this involves a caisson in which the water is discharged through the lower wall, and makes it possible to improve the uniformity of the distribution of the aqueous fluid to the apertures.

The use of a corrosion-resistant material for the rings and tubular members prevents the deterioration of the apertures and ensures that their cross-section remains unchanged.

The present invention also relates to plants for cooling a metal product using the apparatus described above. Such a plant for cooling, by means of an aqueous fluid, a moving metal product having at least one plane surface comprises a plurality of apparatuses of the type described above disposed opposite at least one, and preferably all, of the plane surfaces of the product. In this plant, it is advantageous if the walls provided with the apertures belonging to the devices disposed opposite the same plane surface of the product are disposed in the same plane and if the walls follow one another in the direction of movement of the product.

In accordance with a particularly advantageous embodiment, the plant for the cooling of a metal product having at least one plane upper and lower surface which are substantially horizontal, in particular a sheet of metal which is displaced on a roller conveyor, comprises:

(A) a lower fixed assembly, comprising:
- (a) lower caissons disposed below the product between the rollers of the conveyor such that their front faces are set back with respect to the plane of contact between the product and the conveyor rollers;
- (b) means for supplying these lower caissons with aqueous cooling fluid;

(B) an upper assembly which may be moved in a vertical direction, comprising:
- (c) upper caissons, disposed above the product and substantially opposite the lower caissons;
- (d) cross-struts between the upper caissons and having a rectangular section whose width is equal to the spacing between two adjacent caissons and whose height is greater than the height of the upper caissons, these cross-struts being made rigid with the adjacent caissons such that their lower faces are disposed on the same level as the front faces of the upper caissons;
- (e) longitudinal girders from which the assembly formed by the cross-struts and the upper caissons is suspended, this suspension preferably being achieved by welding the cross-struts to the longitudinal girders;
- (f) transverse frame plates supporting the longitudinal girders;
- (g) means for supplying the upper caissons with aqueous cooling fluid;

(C) means for adjusting the vertical position of the upper movable assembly (B) with respect to the lower fixed assembly (A), comprising:
- (h) a motor rigid with the movable assembly (B) and mounted above the cross-struts;

(i) jacks disposed at the ends of the transverse frame plates and supported on the base of the overall assembly;

(j) a distribution mechanism mounted on the said movable assembly (B) and providing for the control of the jacks by the motor;

(D) means for removing the aqueous fluid discharged by the upper and lower caissons.

BRIEF DESCRIPTION OF THE DRAWINGS

The invention will be described further, by way of example, with reference to the accompanying drawings, wherein.

DETAILED DESCRIPTION OF PREFERRED EMBODIMENT

The following description relates to a particular embodiment of a plant for the cooling of sheet metal, for example on discharge from a hot rolling mill. This description is given by way of non-limiting example and the plant described could, without departing from the scope of the invention, be modified in a suitable way to adapt it to the cooling of other products, for example profiled sections, provided that these have at least one plane surface.

Figure 1:
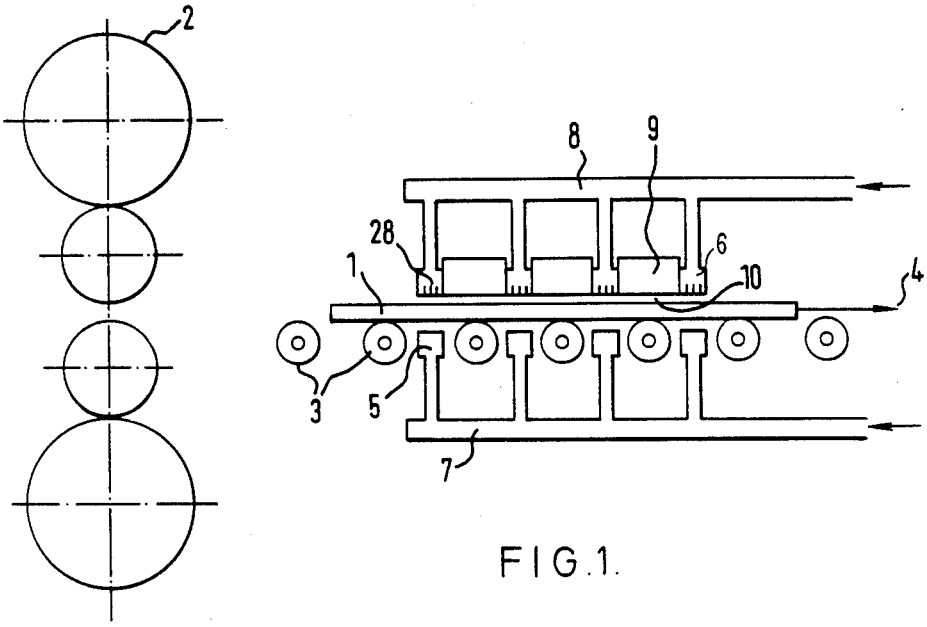
FIG. 1 is a diagrammatic side view of part of a plant for cooling sheet metal on discharge from a rolling mill.

FIG. 1 shows a metal sheet 1 which, on discharge from a rolling mill 2, is moved on a roller conveyor 3 in the direction of the arrow 4. This sheet passes through a cooling plant comprising, on one hand, lower caissons 5 disposed between the rollers of the conveyor 3 and, on the other hand, upper caissons 6 disposed substantially above the lower caissons 5. The upper and lower caissons 6 and 5 are supplied with aqueous fluid (e.g. water) by respective supply conduits 8 and 7. Between the upper caissons 6 there are disposed cross-struts 9 whose lower faces are disposed in the plane containing the front faces (the walls provided with apertures) of the upper caissons. These cross-struts 9 provide, on one hand, for the continuity of the surface facing the product and consequently the uniform thickness of the chamber 10 supplied with aqueous fluid and, on the other hand, maintain the selected spacing between adjacent caissons 6. They also eliminate any risk of the sheet 1 becoming caught up in the upper caissons 6. The aqueous fluid supplied through the conduits 7 and 8 is discharged to a collection device (not shown) after cooling the sheet 1 in the chamber 10.

Figure 2:
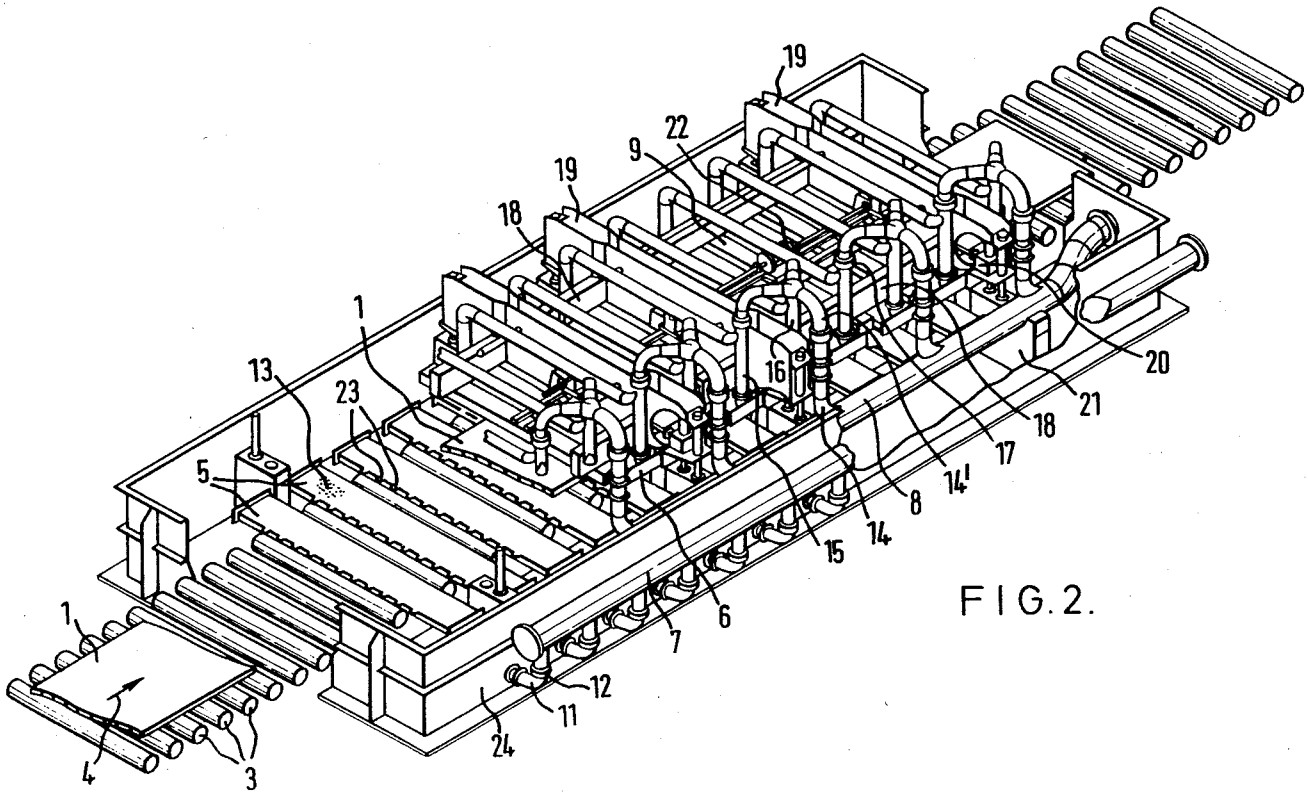
FIG. 2 is a diagrammatic cut-away perspective view of the overall plant.

This plant is shown in a more detailed way in FIG. 2, which shows a continuous sheet or strip 1 entering the cooling plant. The strip 1 is displaced horizontally on rollers 3 between which the lower caissons 5 are disposed. These are positioned such that their front faces are located at a spacing of 10 to 100 mm below the plane of contact between the strip and the rollers. Such a spacing prevents any risk of the sheet becoming caught up in the lower caissons, while providing for satisfactory and efficient cooling. The lower caissons 5 are supplied individually with aqueous fluid from the conduit 7. Each individual conduit branch 11 is provided with a valve 12 making it possible to isolate the corresponding lower caisson. The upper faces of the caissons 5 are drilled with apertures 13 having a diameter of 0.5 to 10 mm, preferably 0.5 to 1 mm. There are at least 100 apertures per square meter in the case of the largest apertures, with increased numbers of apertures with smaller diameters so as to maintain the passage cross-section and consequently the desired rate of flow of the aqueous fluid. The front faces of the caissons are provided with teeth 23 projecting substantially horizontally and preferably upstream so as to guide the sheet whilst enabling the flow of part of the aqueous fluid.

The upper caissons 6, whose front faces (i.e. their faces facing the strip 1) are also drilled with apertures similar to the apertures 13, are disposed opposite the lower caissons 5. It is not absolutely necessary, for the purposes of the invention, for each upper caisson 6 to be located strictly opposite a lower caisson 5. The spacing between the upper caissons may differ from the spacing between the lower caissons without departing from the scope of the invention. The upper caissons 6 are supplied with aqueous fluid from the conduit 8. Each conduit branch 14 is sub-divided into two separate conduits 15 and 16 each supplying a caisson and provided with valves 17 enabling the corresponding upper caisson to be isolated.

Figure 3:
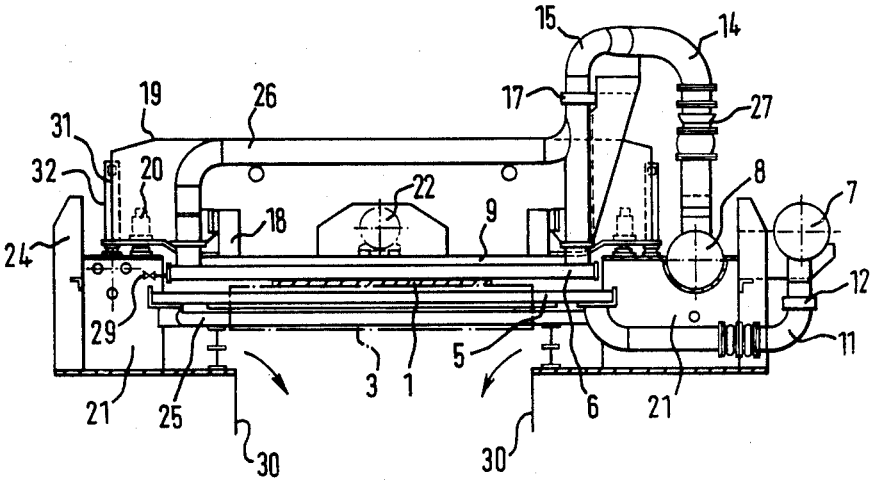
FIG. 3 is a transverse cross-sectional through the plant of FIG. 2, showing the supply circuits for the aqueous fluid as well as the means for adjusting the spacing between the wall provided with apertures and the surface of the sheet.

The supply circuit for both the upper and the lower caissons is shown in further detail in FIG. 3.

As shown in FIG. 1, the spaces between the upper caissons 6 are occupied by cross-struts 9. These struts 9 are made rigid in a suitable manner with the caissons 6 and are higher than the caissons 6. As the front faces of the caissons 6 and the cross-struts 9 have to be disposed in the same plane, for the reasons mentioned above, the rear faces of the cross-struts 9 project with respect to the caissons 6. The cross-struts 9 are fixed in a rigid manner, preferably by welding, by means of this rear face to longitudinal girders 18 which are in turn supported by transverse frame plates 19. The ends of these transverse frame plates 19 are supported via jacks 20 on bases 21 rigid with the plant foundation. These jacks 20 enable the vertical displacement of the rigid assembly formed by the frame plates 19, the longitudinal girders 18, the cross-struts 9, and the upper caissons 6 so as to make it possible to vary, as necessary, the spacing between the front faces of the caissons 6 and the upper surface of the sheet 1. The jacks 20 are driven, via a transmission which is known per se, by means of a motor 22 mounted on the rear of the cross-struts 9 and preferably in the longitudinal median plane of the cross-strut/upper caisson assembly. The motor 22 is thus protected against vapors which are inevitably released from the cooling chamber.

The cross-struts 9 and the longitudinal girders 18 are hollow and closed at their ends and communicate with one another at their points of intersection. They consequently form a circuit through which cooling fluid, preferably water, passes so as to prevent any deformation due to heat in cases where a hot product becomes jammed in the plant. This cooling fluid advantageously comes from the cooling circuit for the rolling mill rolls disposed upstream such that its supply is independent of the caisson supply circuit and is not therefore modified if there is an intentional or accidental decrease or stoppage of the supply to the caissons 5, 6.

The overall plant is surrounded by a wall 24, preferably vertical, which prevents any undesirable lateral discharge of the aqueous cooling fluid. This wall obviously has inlet and outlet openings for the passage of the sheet through the plant. These openings are provided with means designed to prevent the discharge of the aqueous fluid via these openings. These means are advantageously formed by devices for spraying the aqueous fluid in a transverse direction, which devices return this fluid to the chamber between the walls and then to the collection device.

Finally, the inlet opening provided in the vertical wall is equipped with means for guiding the sheet coming from the rolling mill and entering the plant. Such means is advantageously formed by a guide or deflector, which may itself be of sheet metal, forming a funnel in front of the inlet opening.

FIG. 3 shows the conduits 8,7 for the supply of aqueous fluid to the upper and lower caissons 6,5 and the jacks 20 which carry out the vertical positioning of the upper caissons 6.

In order to ensure that there is a symmetrical and balanced supply to each lower caisson 5, the branch 11 connected to one end of the caisson is provided with a branch circuit 26 which supplies half of the aqueous fluid to the other end of the caisson. It would not, however, lie outside of the scope of the invention to provide additional branch circuits supplying a corresponding portion of the aqueous fluid to other points of both the upper and the lower caissons. It should also be noted that the branch 14 comprises means enabling the assembly comprising the upper caissons to be moved with respect to the supply conduit 8 without any loss of leak-tightness. These means advantageously comprise a device 27 in which the branch is formed by a first portion 14 and a second portion 14' having a slightly smaller diameter than the first portion 14. The end of the portion 14' is engaged and may slide in the portion 14 in response to variations of the vertical position of the upper caissons 6 and the leak-tightness of the two portions is ensured by an elastic membrane controlled by gas pressure.

Figure 4:
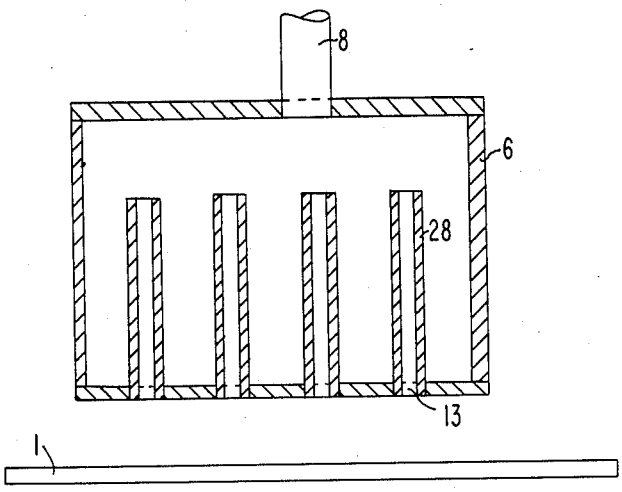
FIG. 4 is an enlarged transverse cross-sectional view through an upper caisson.
Figure 5:
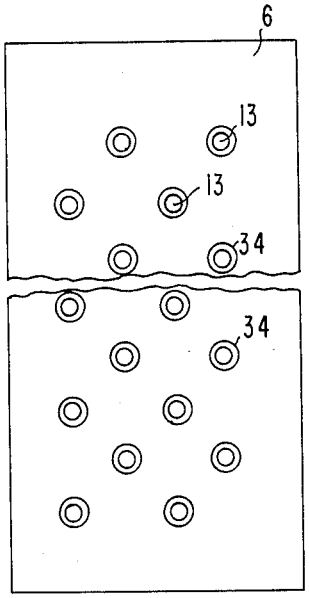
FIG. 5 is a plan view of a caisson face having apertures showing a zig-zag embodiment of the apertures.

In accordance with an embodiment already discussed above, the apertures 13 of the upper caissons 6 are advantageously provided with tubular members 28 extending within the caissons as best shown in the enlarged view of FIG. 4. FIG. 5 is an enlarged plan view showing the embodiment of the invention wherein the apertures 13 are arranged in a zig-zag manner and are lined with ring-shaped members 34 of corrosion resistant material such as brass or stainless steel. These tubular members facilitate the protection of the caissons 6 against deformation by heat in the comparatively frequent case in which strip which should not be cooled by this method passes through the plant.

The upper caissons 6 are provided with a discharge aperture 29 disposed below the level of the head of the tubular members 28. If necessary, it is also possible to establish and maintain a slight flow of aqueous fluid for the cooling of the caissons 6 without this fluid flowing in an undesirable manner onto the strip.

In this case, the lower caissons 5 are protected by maintaining a sufficient flow of aqueous fluid to make it flow through the apertures 13, but insufficient for it to reach the lower face of the strip which is not to be cooled.

In all cases, the aqueous fluid supplied through the apertures 13 of the upper and lower caissons is collected by the collection device 30 and then, after filtering and cooling by appropriate devices (not shown), returned to the conduits 7 and 8. Additional aqueous fluid may be added at this point to offset losses due predominantly to evaporation.

FIG. 3 also shows the mechanical system for the movable upper assembly formed by the motor 22 and jacks 20 whose movement is transmitted by a transmission of known type. In normal operation, the stroke of these jacks is such that the thickness of the chamber 10 may vary from 5 to 300 mm, preferably from 30 to 300 mm in the case of sheet metal, so as to avoid any risk of obstruction while providing for satisfactory and efficient cooling. It has also been found advantageous to be able to increase this spacing to 500 mm so as to facilitate access if a product becomes jammed.

FIG. 3 also shows that the bases 21 are provided with pivots 31 corresponding to the sleeves 32 fixed on the frame plates 19 and designed to guide the movable upper assembly when it is inserted in the plant.

We claim:

1. A plant for the cooling of a metal product having plane upper and lower surfaces which are substantially horizontal, including a roller conveyor along which the product is to move, the plant further comprising:

(A) a fixed lower assembly, comprising:

(a) lower caissons disposed below the product between the rollers of the conveyor and having front faces set back with respect to the plane of contact between the product and the conveyor rollers; and (b) means for supplying said lower caissons with aqueous cooling fluid, which is discharged through apertures in said front faces;

(B) an upper assembly movable in a vertical direction, comprising:

(c) upper spaced caissons having front faces disposed above the product and substantially opposite said lower caissons;

(d) cross-struts between said upper caissons having a rectangular cross-section whose width is equal to the spacing between two adjacent caissons and whose height is greater than the height of said upper caissons, said cross-struts being made rigid with the adjacent caissons and having lower faces disposed on the same level as said front faces of the upper caissons;

(e) longitudinal girders from which the assembly formed by the cross-struts and the upper caissons is suspended;

(f) transverse frame plates supporting said longitudinal girders; and (g) means for supplying said upper caissons with aqueous cooling fluid, which is discharged through apertures in said front faces of said upper caissons;

(C) means for adjusting the vertical position of the movable upper assembly (B) with respect to the fixed lower assembly (A), comprising:

(h) a motor rigid with the movable assembly (B) mounted above said cross-struts;

(i) jacks disposed at ends of said transverse frame plates and supported on a base of the plant; and (j) a distribution mechanism mounted on the movable upper assembly (B) for controlling said jacks by said motor; and (D) means for removing the aqueous fluid discharged by said upper and lower caissons.

2. A plant as claimed in claim 1 wherein:

said apertures in said front faces of at least said upper caissons are disposed in a zig-zag pattern.

3. A plant as claimed in claim 1 wherein:

said apertures in said front faces of at least said upper caissons comprise at least 100 apertures per square meter and the diameter of the apertures is in the range from 0.5 to 10 mm.

4. Apparatus as claimed in claim 3 wherein:

said diameter is in the range 1 to 5 mm.

5. A plant as claimed in claim 1, wherein:

said cross-struts and longitudinal girders are hollow and are closed at their ends and have internal spaces connected together to form a circuit through which said aqueous cooling fluid passes.

6. A plant as claimed in claim 1, wherein:

said front faces of said lower caissons are provided with teeth projecting substantially horizontally.

7. A plant as claimed in claim 6, wherein:

said teeth project upstream with respect to the direction of movement of the product.

8. A plant as claimed in claim 1, wherein:

said means for the removal of the aqueous fluid comprise a wall surrounding at least said fixed lower assembly (A).

9. A plant as claimed in claim 8, wherein:

said wall has inlet and outlet openings for the passage of the product, said openings being provided with flow preventing means, for preventing said aqueous fluid from flowing out through said openings.

10. A plant as claimed in claim 9, wherein:

said flow preventing means comprise devices for spraying aqueous fluid in a transverse direction with respect to the direction of movement of the product.

11. A plant as claimed in claim 1 and further comprising:

a ring-shaped lining on at least one of said apertures made of material resistant to corrosion by said aqueous fluid.

12. Apparatus as claimed in claim 11 wherein:

said corrosion resistant material comprises brass.

13. Apparatus as claimed in claim 11 wherein:

said corrosion resistant material comprises stainless steel.

14. A plant as claimed in claim 1 and further comprising:

means for regulating the rate of flow of said aqueous fluid.

15. A plant as claimed in claim 1 and further comprising:

at least one tubular member in at least one of said apertures in said front faces of said upper caissons.

16. A plant as claimed in claim 15 wherein:

said at least one tubular member comprises a tubular member in each aperture in said upper caisson; and each tubular member has a length no less than five times the inner diameter thereof.

17. A plant as claimed in claim 15 wherein:

said at least one tubular member is made of material resistant to corrosion by said aqueous fluid.

18. A plant as claimed in claim 19 wherein:

said corrosion resistant material comprises brass.

19. A plant as claimed in claim 17 wherein:

said corrosion resistant material comprises stainless steel.

* * * * *